United States Patent [19]

Frankena

[11] Patent Number: 4,931,217

[45] Date of Patent: Jun. 5, 1990

[54] AUTOMATIC DISHWASHING DETERGENT COMPRISING QUATERNARY AMMONIUM SALT

[75] Inventor: Hidde Frankena, Vlaardingen, Netherlands

[73] Assignee: Lever Brothers Company, New York, N.Y.

[21] Appl. No.: 276,974

[22] Filed: Nov. 28, 1988

[30] Foreign Application Priority Data

Nov. 26, 1987 [GB] United Kingdom ..... 8727659

[51] Int. Cl.[5] ..... C11D 1/62; C11D 3/395

[52] U.S. Cl. ..... 252/547; 252/95; 252/99; 252/102; 252/528

[58] Field of Search ..... 252/99, 102, 528, 547

[56] References Cited

U.S. PATENT DOCUMENTS

| | | | |
|---|---|---|---|
| 3,941,710 | 3/1976 | Gilbert et al. | 252/99 |
| 3,962,106 | 6/1976 | Rubin et al. | 252/99 |
| 3,966,627 | 6/1976 | Gray | 252/99 |
| 4,259,217 | 3/1981 | Murphy | 252/547 |
| 4,347,168 | 8/1982 | Murphy et al. | 252/547 |

FOREIGN PATENT DOCUMENTS

| | | |
|---|---|---|
| 37161 | 10/1981 | European Pat. Off. . |
| 171007 | 7/1985 | European Pat. Off. . |
| 171006 | 2/1986 | European Pat. Off. . |
| 171008 | 2/1986 | European Pat. Off. . |
| 1296839 | 11/1972 | United Kingdom . |
| 2172607 | 9/1986 | United Kingdom . |

*Primary Examiner*—Prince E. Willis

*Attorney, Agent, or Firm*—Milton L. Honig

[57] ABSTRACT

Machine dishwashing compositions comprising quaternary ammonium salts of formula:

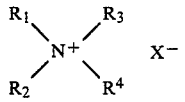

wherein from one to three members of $R_1$, $R_2$, $R_3$ and $R_4$ represent alkyl chains which may be the same or different, at least one of said alkyl groups representing a $C_8$–$C_{26}$ group, those members of $R_1$, $R_2$, $R_3$ and $R_4$ which do not represent alkyl groups representing ethoxy groups, the total ethoxylation value within the molecule being at least 5 and $X^-$ representing an anion, enable washing to be carried out efficiently at lower temperatures. Fat removal is enhanced.

6 Claims, No Drawings

AUTOMATIC DISHWASHING DETERGENT COMPRISING QUATERNARY AMMONIUM SALTThe present invention relates to dishwashing compositions, more particularly to compositions suitable for use in machine dishwashers operating at low temperatures.

Detergent compositions for use in the cleansing of soiled dish- and cookware in machines are well known in the art. In general they are powders comprising mixtures of inorganic alkali salts such as alkali-metal silicates, phosphates and carbonates, optionally together with a bleaching agent and a minimal amount of a low-foaming nonionic detergent active. The mechanical cleansing is usually carried out by means of jets of water, either from a high-pressure pump or produced by a high-speed propeller. It is essential for the correct operation of the machine that the composition is substantially or completely non-foaming.

The cleaning compositions known in the art have been found to work best at bath temperatures of from 55° C. to 65° C. This high temperature is necessary to ensure that fat and grease soils can be removed. The compositions are formulated to remove all soils, burnt materials, amylaceous products, dyes and the like, but without corrosive effect on dishware made of glass, china and metal. Moreover, compositions should be such that the formation of films and spots on the cleaned surface is substantially avoided.

There is a desire to carry out the dishwashing process at lower temperatures in order to reduce energy requirements. For example, a process carried out at a temperature of 50° C. as compared to 65° C. represents a saving of 0.6 kW hr/wash. However, conventional detergent materials cannot be used at these lower temperatures since the ability to remove soil is greatly reduced, particularly the ability to remove fat-based soils. It would be particularly preferred to carry out all washing on so-called "Economic" cycles, which operate at a wash temperature of 50° C.

European Patents Nos 171 006, 171 007 and 171 008 describe different additives for use in low-temperature machine dishwashing compositions, including primary alkylamines, long-chain epoxy alkanes and alkanols.

The present invention relates to the discovery that certain materials may be added to conventional detergent compositions which improve the cleaning ability of said compositions at low temperatures, whilst not increasing the foam above conventional levels.

Accordingly, the present invention provides a machine dishwashing composition comprising a quaternary ammonium salt of general formula:

Conventional machine dishwashing compositions in general contain a significant amount of inorganic, relatively alkaline salts, such as alkali metal phosphates, alkali metal silicates and alkali metal carbonates, a bleaching system providing active chlorine or oxygen and, optionally, ingredients such as proteolytic and/or amylolytic enzymes, and nonionic surfactants for foam-reduction and wetting.

According to a more limited aspect of the invention it has been found that it is possible to formulate machine dishwashing compositions of equal or superior efficiency to conventional compositions particularly at low washing temperatures based on inorganic salts, bleach, enzymes and optionally a nonionic surfactant, to which is added one or more quaternary salts as defined above.

The addition of the compounds defined above has been found to increase the removal of fatty soil from soiled dishware. In fact, the additives cause fat to slide off the hard surface. The additives show a further benefit in that they act as anti-bacterial agents. Thus, articles washing in compositions containing them will show an increased cleanliness in terms of bacterial residues.

Preferred additives are those wherein one of $R_1$ and $R_2$ represents a methyl and/or butyl group, the average ethoxylation number ranging from 10 to 20. Preferred long-chain groups are $C_{10-C18}$ groups.

Particularly preferred are additives wherein:

$$R_1 = Me \quad R_2 = CoCo \quad x + y = 15$$

and $$R_1 = Me \quad R_2 = \text{stearyl} \quad x + y = 15$$

[These additives are commercially available as Ethoquad C25 and HT25 respectively (Akzo, Italy).]

The additive may be present at from 0.5 to 20 wt % within the composition, particularly from 2 to 12 wt %.

The machine dishwashing compositions according to the invention may comprise one or more salts suitable to provide adequate alkalinity and buffering capacity. Thus, they may comprise organic and/or inorganic builder and filler salts such as the alkali metal salts of silicate, in particular metasilicate, carbonate, borate, citrate, carboxymethyloxysuccinate, nitrilotriacetate and ethylenediaminotetraacetate, as well as polyelectrolytes such as polyacrylate, polymethacrylate, and polyamaleate. Polyelectrolytes may be present at 0–20% by weight. Examples include Sokalan CP5, Sokalan CP7, Gantrez and Builder U. Molecular weights may range from 1,000–5,000,000. Also combinations of the above salts among themselves or with inert filler salts such as sodium sulphate are possible.

The amount of the above salts may vary between 10 and 90% by weight of the composition, and normally lies between 30 and 70% by weight.

The compositions according to the invention may further comprise a bleach component, which may be of both the oxygen- and chlorine-releasing type. Suitable chlorine-releasing bleaches include the well-known alkali metal hypochlorites and chlorinated cyanuric acid salts. Because the compositions may also contain one or more enzymatic components, these should either be protected against attack by such chlorine-releasing bleaches, e.g. by encapsulating them, or, and this is preferred, oxygen-releasing bleaches should be used. Particularly preferred in the present invention is the use of a peroxygen salt such as sodium perborate tetrahydrate or monohydrate, percarbonate and persilicate. It may also be advantageous to combine such a persalt with a bleach activator therefor.

The activators for peroxygen salts are organic compounds which react with the peroxygen salt in solution to form an organic peroxygen acid as the effective bleaching agent. Numerous examples of such activators are known in the art. Preferred activators for use in the present invention are tetraacetylethylenediamine, tetraacetylglycoluril, glucosepentaacetate and xylose tetraacetate.

The peroxygen salt is normally included in an amount of up to 25% by weight, in particular of from 3 to 15% by weight of the total composition.

Where also an activator for the bleach is included, the ratio between the peroxygen salt and the activator lies in the range of from 8:1 to 1:1, preferably 4:1 to 1.5:1.

Although optional, the compositions of the present invention preferably also comprise a surfactant which should be of essentially nonionic character. In particular, low- to non-foaming nonionic surfactants selected from the group consisting of alkoxylated nonionic surfactants wherein the alkoxy moiety consists of ethylene oxide, propylene oxide and/or butylene oxide or mixtures thereof may be used.

Examples of suitable and preferred low- to non-foaming nonionics for use in the present invention are the ethoxylated straight-chain alcohols sold under the trade names of Synperonic LF/RA 30 and Synperonic LF/RA 40 by the ICI Company, Lutensol LF 403 and Lutensol LF 1300 by the BASF Company, and Triton DF 12 by the Rohm & Haas Company.

The amount of the nonionic surfactant should be such that detergency and wetting are improved, and excessive foaming due to certain proteinaceous soils is reduced or suppressed. In general, amounts will be between 0.2 and 10% by weight, in particular between 0.5 and 5% by weight of the total composition.

The compositions according to the present invention should be substantially free from other types of surfactants, such as anionic or cationic surfactants.

The enzymes may be of the amylolytic, proteolytic and lipolytic type or mixtures thereof. The amylolytic enzymes for use in the present invention can be those derived from bacteria or fungi. Preferred amylolytic enzymes are those described in British Patent Specification No. 1 296 839, cultivated from the strains of *Bacillus licheniformis* NCIB 8061, NCIB 8059, ATCC 6334, ATCC 6598, ATCC 11 945, ATCC 8480 and ATCC 9945 A. A particularly preferred enzyme is an amylolytic enzyme produced and distributed under the trade name Termamyl by Novo Industri A/S, Copenhagen, Denmark. These amylolytic enzymes are generally sold as granules and may have activities from about 2 to 10 Maltose units/milligram. The amylolytic enzyme is normally included in an amount of from 0.1 to 5% by weight, in particular of from 0.3 to 1.5% by weight.

The composition may, and preferably does, also contain a proteolytic enzyme. Examples of suitable proteolytic enzymes are the subtilisins which are obtained from particular strains of *B. subtilis* and *B. licheniformis*, such as those commercially available under the trade names Maxatase, supplied by Gist-Brocades NV, Delft, Netherlands, and Alcalase, supplied by Novo Industri A/S, Copenhagen, Denmark. Particularly preferred are the proteases obtained from a strain of Bacillus having maximal activity throughout the pH range of 8-12, being commercially available under the trade names of Esperase and Savinase, sold by Novo Industri A/S. The preparation of these and analogous enzymes is described in the British Patent No 1 243 784.

These proteolytic enzymes are generally sold as granules and may have enzyme activities of from about 500 to 1700 glycine units/milligram. The proteolytic enzyme is normally included in an amount of from 0.1 to 5% by weight, in particular of from 0.3 to 1.5% by weight.

Clays, e.g. hectorites and montmorillonites, may be included within the compositions. These reduce spot and film formatron, particularly on glassware.

The compositions may further contain useful additives conventional in the machine dishwashing art, such as enzyme-stabilising agents, hydrotropes, perfumes, colouring agents, germicides, soil-suspending agents, aminopolyphosphonic acids and the alkali metal or alkaline earth metal salts thereof, anti-corrosion agents such as fatty acids, benzatriazole and so on.

The compositions of the present invention have been found to be effective at lower pH's than conventional compositions. Accordingly, the products of the present invention should be formulated such that they provide in the wash liquor a pH in the range of from 7 to 11.5, preferably of from 9.5 to 11.0 at a use concentration of about 3 grams/litre in water.

The energy saving to be achieved from using the compositions according to the present invention is considerable. For example, in a conventional machine, the wash is carried out at 65° C. The energy consumed is 1.8 kW hr/wash. The wash using the present compositions may be carried out at 50° C. (1.2 kW hr/wash) or as low as 40° C. (0.8 kW hr/wash).

The products of the invention may be in powder, gel or liquid form.

The invention will now be further illustrated by way of example.

EXAMPLE 1

Compositions comprising (wt %):

| | |
|---|---|
| STP | 35% |
| Na-Carbonate | 9% |
| Na-Disilicate | 15% |
| +/− Additive | 10% |

were formulated.

These were dosed at 3g/litre into a beaker containing water of hardness 15° FH.

Wash temperature was 40° C., for 1 hour, no agitation.

The soil test was 0.5 g fat/slide, each slide being a 25 $cm^2$ glass slide.

On each slide where the additive was present, it was observed that the fatty soil slid from the hard surface, whilst no fat movement was noted on slides treated with control compositions without additive.

I claim:

1. A detergent cleaning composition adapted for use in automatic dishwashing machines comprising:
   (a) from 10 to 90 wt% of a combination of a builder and an alkalinity agent;
   (b) from 3 to 15 wt% of a bleaching agent;
   (c) from 0.2 to 10 wt% of a nonionic surfactant;
   (d) 0.05-20wt % of a quaternary ammonium salt of general formula:

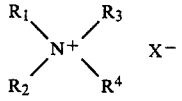

wherein from one to three members of $R_1$, $R_2$, $R_3$ and $R_4$ represent alkyl chains which may be the same or different, at least one of said alkyl groups representing a $C_8$–$C_{26}$ group, those members of $R_1$, $R_2$, $R_3$ and $R_4$ which do not represent alkyl groups representing ethoxy groups, the total ethoxylation value within the molecule being at least 5 and $X^-$ representing an anion, said composition being substantially free from anionic surfactant.

2. A composition as claimed in claim 1 wherein $X^-$ represents a chloride anion.

3. A composition as claimed in claim 1 wherein $R_1$ represents a methyl group, $R_2$ represents a Coco or a stearyl group and the total ethoxylation value is 15.

4. A composition as claimed in claim 1, wherein the ammonium salt is present at from 2 to 12 wt %.

5. A composition according to claim 1 which comprises from 0.1 to 5wt% of an enzyme.

6. A method of cleaning soiled dishware in an automatic dishwashing machine which comprises dissolving or dispersing in an aqueous bath at a temperature of below 0 55° C. an effective amount of a composition according to claim 1, and contacting said soiled dishware with said bath.

* * * * *